US007051804B1

(12) United States Patent
Arning

(10) Patent No.: US 7,051,804 B1
(45) Date of Patent: May 30, 2006

(54) SUBSEA PROTECTIVE CAP

(76) Inventor: Michael Dean Arning, P.O. Box 673064, Houston, TX (US) 77267-3064

( * ) Notice: Subject to any disclaimer, the term of this patent is extended or adjusted under 35 U.S.C. 154(b) by 111 days.

(21) Appl. No.: 10/439,437

(22) Filed: May 16, 2003

Related U.S. Application Data

(60) Provisional application No. 60/431,962, filed on Dec. 9, 2002.

(51) Int. Cl.
*E21B 29/12* (2006.01)
*E21B 19/00* (2006.01)

(52) U.S. Cl. ..... 166/97.1; 166/75.13; 166/368; 166/339

(58) Field of Classification Search ..... 166/335, 166/341, 340, 339, 343, 360, 368, 97.1, 75.1
See application file for complete search history.

(56) References Cited

U.S. PATENT DOCUMENTS

| | | | | |
|---|---|---|---|---|
| 2,605,847 | A | 8/1952 | McCoy | |
| 2,970,646 | A * | 2/1961 | Focht et al. | 166/352 |
| 3,063,500 | A * | 11/1962 | Logan | 166/351 |
| 3,459,259 | A | 8/1969 | Matthews | |
| 3,551,005 | A | 12/1970 | Brun | |
| 3,592,263 | A * | 7/1971 | Nelson | 166/356 |
| 3,638,732 | A | 2/1972 | Huntsinger et al. | |
| 3,722,549 | A | 3/1973 | Wilson et al. | |
| 4,457,448 | A | 7/1984 | Beagell | |
| 4,691,781 | A | 9/1987 | Gano | |
| 4,706,757 | A | 11/1987 | Harrington | |
| 4,867,605 | A | 9/1989 | Myers et al. | |
| 4,936,351 | A | 6/1990 | Wells et al. | |
| 4,943,187 | A * | 7/1990 | Hopper | 405/190 |
| 5,000,719 | A | 3/1991 | Reed | |
| 5,005,650 | A * | 4/1991 | Hopper | 166/339 |
| 5,010,956 | A | 4/1991 | Bednar | |
| 5,050,680 | A * | 9/1991 | Diehl et al. | 166/356 |
| 5,069,287 | A | 12/1991 | Short et al. | |
| 5,107,931 | A | 4/1992 | Valka et al. | |
| 5,129,460 | A | 7/1992 | Ritter, Jr. | |
| 5,184,608 | A | 2/1993 | Hale, III | |
| 5,244,040 | A | 9/1993 | Pecue, II | |
| 5,325,925 | A | 7/1994 | Smith et al. | |
| 5,348,085 | A | 9/1994 | Benson | |
| 5,701,953 | A | 12/1997 | Stecker et al. | |
| 5,868,204 | A | 2/1999 | Pritchett et al. | |
| 5,929,330 | A | 7/1999 | Ford | |
| 5,960,876 | A | 10/1999 | Wiedemann | |
| 5,967,235 | A | 10/1999 | Scott | |
| 5,988,282 | A * | 11/1999 | Jennings et al. | 166/348 |
| 5,992,526 | A | 11/1999 | Cunningham et al. | |
| 6,076,605 | A | 6/2000 | Lilley et al. | |

(Continued)

*Primary Examiner*—Thomas A Beach
(74) *Attorney, Agent, or Firm*—Karen B. Tripp; Elizabeth Layman

(57) ABSTRACT

A cap for covering an open upper end of a subsea structure includes a base and a body. The base has a size, after shrinkage, at least slightly larger than the exterior of the open upper end of the subsea structure. The body is connected to the base and projects downward from the base. The body has an open bottom. The cap is positioned over the open upper end of the subsea structure with the base of the cap resting on the open upper end of the subsea structure and the body of the cap forms a wall around the exterior of the open upper end of the subsea structure for inhibiting the cap from slipping off the open upper end of the subsea structure.

11 Claims, 4 Drawing Sheets

U.S. PATENT DOCUMENTS

| | | | | |
|---|---|---|---|---|
| 6,105,669 | A | 8/2000 | Davis | |
| 6,109,352 | A | 8/2000 | Edwards et al. | |
| 6,474,416 | B1 | 11/2002 | Beall et al. | |
| 6,554,073 | B1 * | 4/2003 | McGarian | 166/361 |
| 6,502,632 | B1 | 6/2003 | Pittman | |
| 6,612,368 | B1 * | 9/2003 | Kent et al. | 166/75.13 |
| 6,615,923 | B1 | 9/2003 | Lay, Jr. et al. | |
| 6,675,900 | B1 * | 1/2004 | Baskett et al. | 166/379 |
| 6,681,850 | B1 * | 1/2004 | Bartlett et al. | 166/86.2 |
| 6,763,891 | B1 * | 7/2004 | Humphrey et al. | 166/368 |
| 6,817,417 | B1 * | 11/2004 | Blair et al. | 166/335 |
| 6,845,815 | B1 * | 1/2005 | Hergarden et al. | 166/92.1 |
| 2002/0000315 | A1 * | 1/2002 | Kent et al. | 166/85.4 |
| 2003/0010499 | A1 | 1/2003 | Qvam et al. | |
| 2003/0019632 | A1 | 1/2003 | Humphrey et al. | |

* cited by examiner

SUBSEA PROTECTIVE CAP

REFERENCE TO RELATED PROVISIONAL APPLICATION

This application claims the benefit of the filing date of U.S. provisional patent application Ser. No. 60/431,962 filed Dec. 9, 2002 by Michael Arning and entitled SUBSEA PROTECTIVE CAP.

BACKGROUND

1. Field of the Invention

This invention relates to the subsea environment and specifically to the protection of associated subsea structures such as wellheads, caissons, mud line wells, trees and flowline hubs.

2. Background of the Invention

A typical subsea scenario requiring the installation of a cap commences when an operation, such as drilling a subsea well, is suspended or terminated. During the preceding drilling operation a foundation casing is washed down and inserted into the seabed such that approximately ten feet of the casing protrudes upward from the seabed. A hole is then drilled through the primary foundation and down to a predetermined depth. The next section of pipe is then run into the drilled hole and landed inside the previous foundation casing. On top of this section of pipe typically is a wellhead of various inner and outer diameters. The top of the wellhead is now about thirteen feet above the sea floor. This last section contains a seal pocket that will allow it to seal when attached to a Blow-Out-Protector ("BOP") or other sealing or connecting equipment. This seal pocket can be capable of containing pressures at or in excess of 15,000 psi.

The drilling rig then runs a BOP device that will latch onto the wellhead creating a sealed conduit from the subsea structure back up to the drilling rig where the pressure can be observed and controlled. Between the section and the BOP is a gasket. This gasket is in contact with both the wellhead and the BOP and creates a seal. Any abnormalities in the wellhead seal pocket could keep the seal from holding. Therefore, protecting this exposed seal pocket in the wellhead becomes very important in the life of the well and/or equipment.

The well is drilled for exploration or development. Once the well has been drilled and the rig is ready to move off location or move to another well, the BOP is disconnected from the wellhead. The seal pocket on the wellhead is now exposed and vulnerable to dropping and/or foreign objects. A subsea well can cost several millions of dollars to drill. Leaving the wellhead exposed to damage from falling objects or other intruders could result in loss of the seal integrity and thereby render the wellhead useless.

When a wellsite is abandoned or temporarily suspended, it is desirable to protect the wellhead. During the installation of a subsea flow line, the drilling of a subsea well, the drilling of a mudline suspension well or the installation of a subsea tree, it may be necessary to suspend the operation due to inclement weather or requirement of additional equipment. When the operations have been suspended or completed, the end or top of the pipe or equipment has a seal area or a profile that needs to be protected from foreign objects, damage and/or marine growth. These seals, surfaces and profiles have varied outer and inner diameters, shapes and lengths. They also may contain seal pockets or integral components that need to be protected from corrosion and/or marine growth.

Because of the potential for enormous loss of time and money and the need for protection on multiple structure profiles, it is desirable to have a cap for a subsea structure that has the following characteristics:

(1) Protects an open subsea structure from falling matter and foreign objects;

(2) Fits on many profile-dissimilar structures (wellheads, caissons, trees, flowline hubs, etc.) without modification;

(3) Installable and/or removable by an ROV and/or diver or surface/rig mounted winch;

(4) Sufficient sealing characteristics derived by weight of cap and pressure of surrounding seawater if cap is required to contain corrosive-inhibiting and/or other fluids such as marine-growth-inhibitors;

(5) Installable to the structure without locking to the structure;

(6) Removable from the structure without unlocking from the structure;

(7) No orientation required for installation other than lowering the cap onto the structure;

(8) No external pressure requirements to accomplish its job other than pressure from surrounding seawater;

(9) Moveable from one subsea structure to the next without resurfacing;

(10) Easily removeable/reinstallable for structure cleaning operations;

(11) Reusable without replacing any parts; and

(12) Inexpensive to manufacture and maintain.

Current methods of protecting an exposed wellhead or other structure include the capping of a structure by a device such as disclosed in U.S. Pat. No. 5,107,931 ("the '931 patent"). Although the '931 patent meets one of the basic requirements (#1: protects the open subsea structure from falling matter and foreign objects), it fails to meet or even disclose any of the other requirements (#2–11) listed above.

For example, the cap of the '931 patent is designed specifically to latch to a wellhead to form a seal (fails #4, 5, 6) and must mate exactly with existing elements of that wellhead. This means that it will not work on any other type of subsea structure that does not have the identical mating elements (fails #2). Additionally, the cap of the '931 patent is designed to work with a drill string tool only (fails #3) and requires orientation (fails #7) and pressure from the tool to latch to and unlatch from the structure (fails #8). Because pins located in the wall of the '931 cap are sheared off during operation, new pins must be retrofitted to prepare the cap for another job (fails #9, 10 and 11). Because the '931 cap requires a complex latching and release mechanism to install and remove the cap, it will not be inexpensive to manufacture or maintain (fails #12).

One of the most prominent characteristics of currently available protective coverings for subsea structures is that the size and shape of the covering must be closely matched to the size and shape of the subsea structure to enable the covering to mate with and latch to the structure. This design constraint means that there must be different coverings for different applications and the mating/latching requirements mean that the covering is much more expensive to manufacture and maintain.

In general, the approach of the prior art has been to focus on a particular aspect of protection that is very structure-dependent, costly to manufacture and complex to operate. None of the prior art meets the requirements set forth above. It would, therefore, be a significant advancement in the art and it is an object of the present invention to provide an improved cap that is simple to manufacture, install and remove and that meets all of the desired requirements cited above.

SUMMARY OF THE INVENTION

This invention satisfies the need in the industry for an improved protective cap for subsea structures. A cap for covering an open upper end of a subsea structure is provided which include a base and a body. The base has a size, after shrinkage, at least slightly larger than the exterior of the open upper end of the subsea structure. The body is connected to the base and projects downward from the base. The body has an open bottom. The cap is positioned over the open upper end of the subsea structure with the base of the cap resting on the open upper end of the subsea structure to protect the subsea structure from falling or foreign objects and the body of the cap forming a wall around the exterior of the open upper end of the subsea structure for inhibiting the cap from slipping off the open upper end of the subsea structure.

A further aspect of the invention provides an inlet, a pipe inserted through an aperture in the base and an outlet to allow a corrosive-inhibitor or a marine growth inhibitor fluid to be inserted into the open upper end of the subsea structure thereby displacing seawater which flows up through the pipe and out through the outlet.

Another aspect of the invention provides a plate covered by a corrosive resistant material to form the base and an insert covered by a corrosive resistant material to form the body, wherein the plate and the insert minimize shrinkage of the cap.

Still other benefits and advantages of this invention will become apparent to those skilled in the art upon a reading and understanding of the following detailed specification and related drawings.

BRIEF DESCRIPTION OF THE DRAWINGS

The objects, advantages and features of the invention will become more apparent by reference to the drawings, which are appended hereto and made a part thereof.

DESCRIPTION OF THE PREFERRED EMBODIMENT

Figure 1:
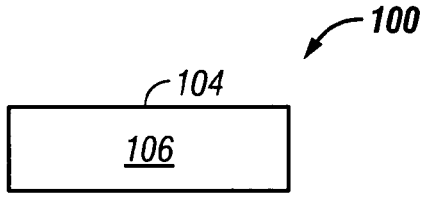
FIG. 1 is a side view of an embodiment of the invention.
Figure 2:
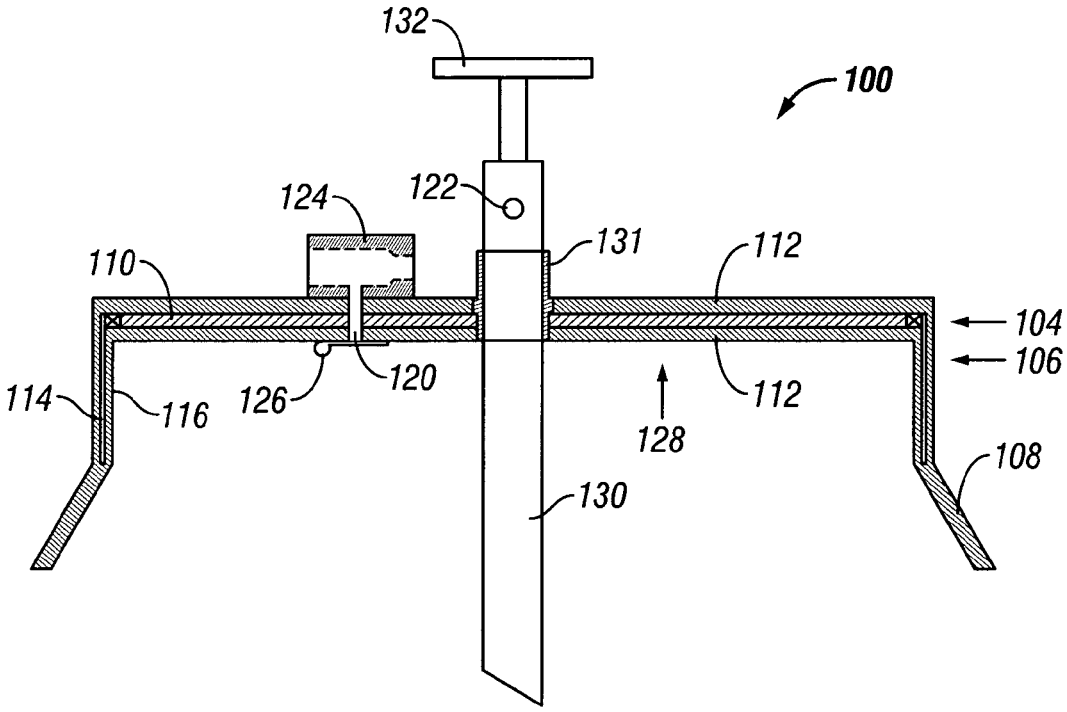
FIG. 2 is a sectional side view of another embodiment of the invention.

FIG. 1 is a side view of a cap 100 of the present invention showing the two elements, a base 104 and a body 106, of the cap 100. The body 106 of the cap 100 is open at the bottom and attached to the base 104 at the top of the body 106. The base 104 can be of any shape (such as round, oval, square, rectangular, irregularly-shaped, etc.) that covers the open upper end of the subsea structure. The base 104 of the preferred embodiment, as shown in FIGS. 1 and 2, is circular. This is meant by way of example and is not meant to limit the scope of the invention.

FIG. 2 is a sectional side view of another embodiment of the present invention also showing the two elements, the base 104 and the body 106, of the cap 100. An inverted funnel or flanged skirt 108 can be added to expedite the installation of the cap 100 onto the structure to be protected. The base 104 of the cap 100 in this embodiment is a circular plate-like structure, which forms the bottom of an inverted bowl shape when attached to the body 106. Encasing a plate 110 in a corrosion-resistant material forms the base 104 of the cap 100.

In this preferred embodiment, the plate 110 is made of metal and encased in a plastic material such as polypropylene to form a shell 112. Materials other than metal (for the plate 110) and thermoplastic polymers (for the shell 112) that meet the requirements of the product (such as density, limited shrinkage, etc.) can be used. The shrinkage factor must be such that after full shrinkage resulting from submersion in seawater, the cap 100 remains large enough to cover the open upper end of the subsea structure without pressing against the structure (for ease of removal of the cap). Other examples of encasing materials include fiberglass, polyethylene and polyurethane.

The body 106 of the cap 100 of the preferred embodiment, as shown in FIG. 2, comprises a metal liner 114 encased in plastic to control shrinkage of the outer cylinder such as that used for the base 104. For additional structural integrity, the plate 110 and the liner 114 are connected to each other and then the resulting integrated plate 110 and liner 114 are encased in plastic to form an integrated shell 112. These materials are meant by way of example and are not meant to limit the scope of the invention.

The base 104 can have one or more inlet ports 120, as shown in FIG. 2. The base 104 also can include one or more outlets or exhaust ports 122. The inlet ports 120 can be used for injecting or pumping fluid into the structure after the cap 100 is installed. Because the cap 100 is not designed to contain pressure, the exhaust/outlet port 122 allows venting of unwanted air or fluids (not shown) from the structure as a material, such as a lubricating fluid, is injected or pumped into the structure through the inlet port 120.

Figure 3:
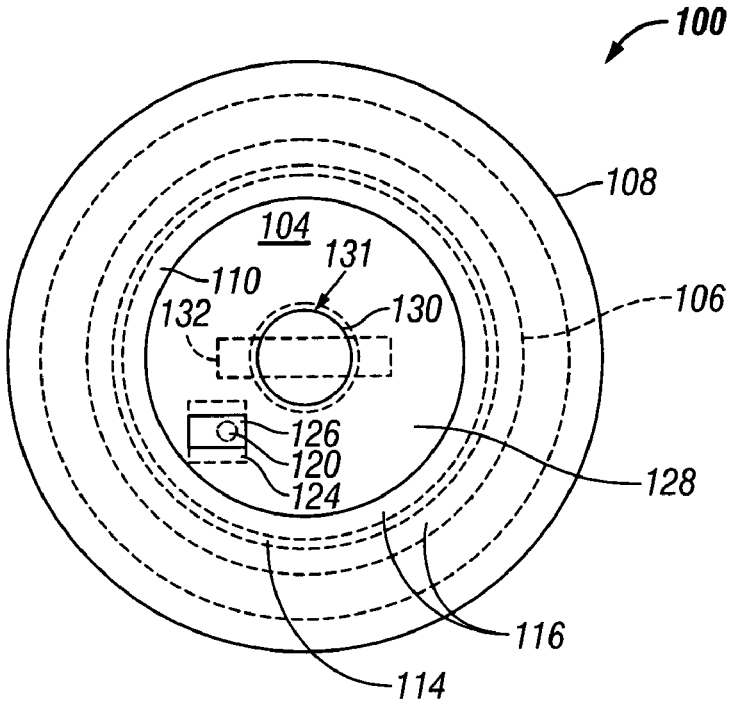
FIG. 3 is a bottom view of an embodiment of the invention.
Figure 4:
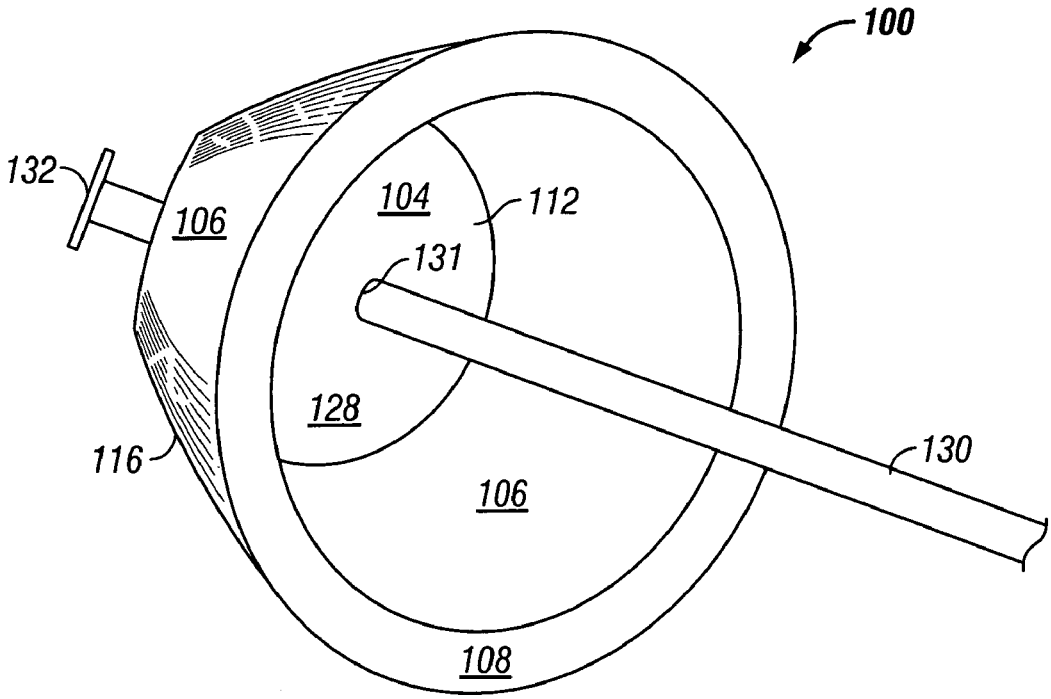
FIG. 4 is a bottom perspective view of an embodiment of the invention.

As shown in FIG. 2, a stab receptacle 124 is connected to the inlet port 120 on the base 104 of the cap 100. A self-sealing flapper 126 is located on the underside 128 of the base 104 to prevent any reverse flow through the inlet port 120. A threaded pipe 130 can be attached to the base 104 by screwing the pipe 130 into a threaded aperture 131 in the base 104 of the cap 100, as shown in FIG. 2, FIG. 3 and FIG. 4, for installing siphon tubes and attachment devices (not shown). FIG. 4 illustrates the cap 100 with the threaded pipe 130 attached to the base 104.

To allow easier manipulation of the cap 100 during installation and removal operations, a handle 132 is attached to the cap 100, as shown in FIG. 2. The handle 132 can be attached anywhere on the cap 100 that allows a Remotely-Operated Vehicle or a diver or a cable to manipulate the cap 100. The handle 132 in the preferred embodiment is shown attached to the top of the pipe 130. This is meant by way of example and is not meant to limit the scope of the invention.

Figure 5:
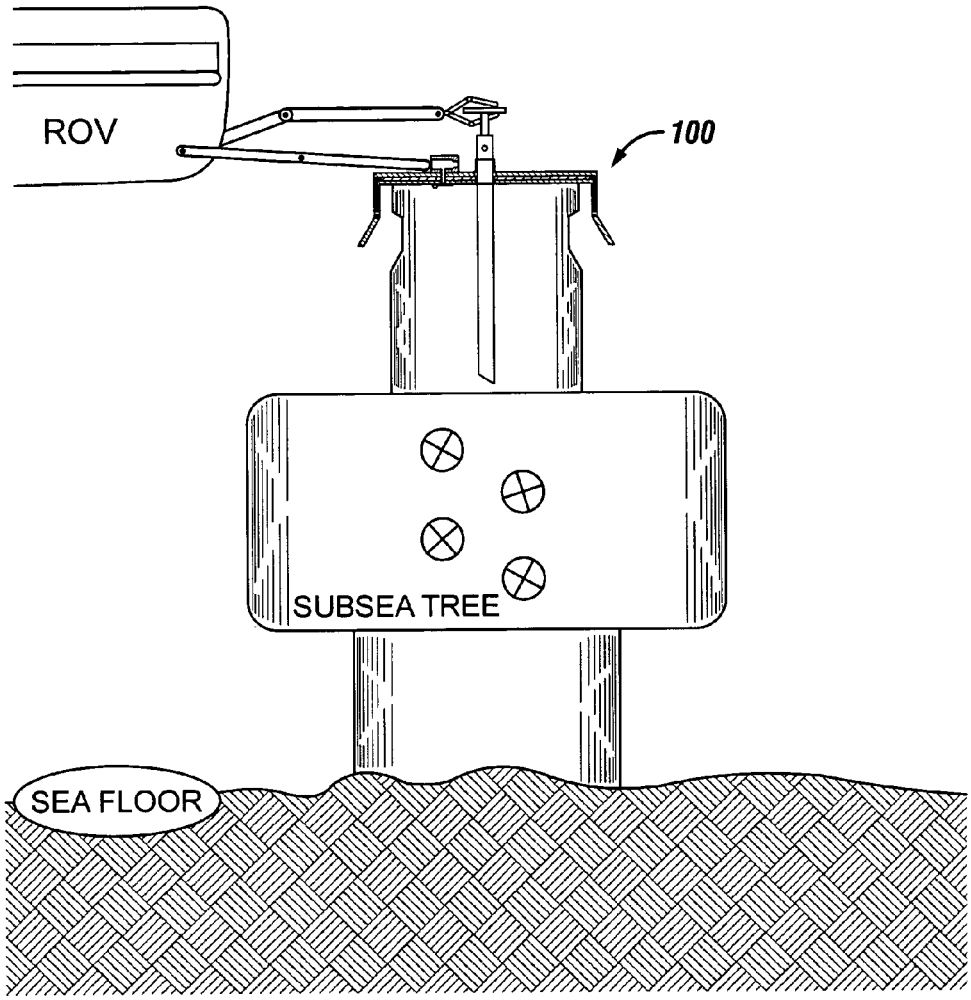
FIG. 5 is a side view of an embodiment of the invention being installed on a subsea tree by a Remotely-Operated Vehicle (ROV).
Figure 6:
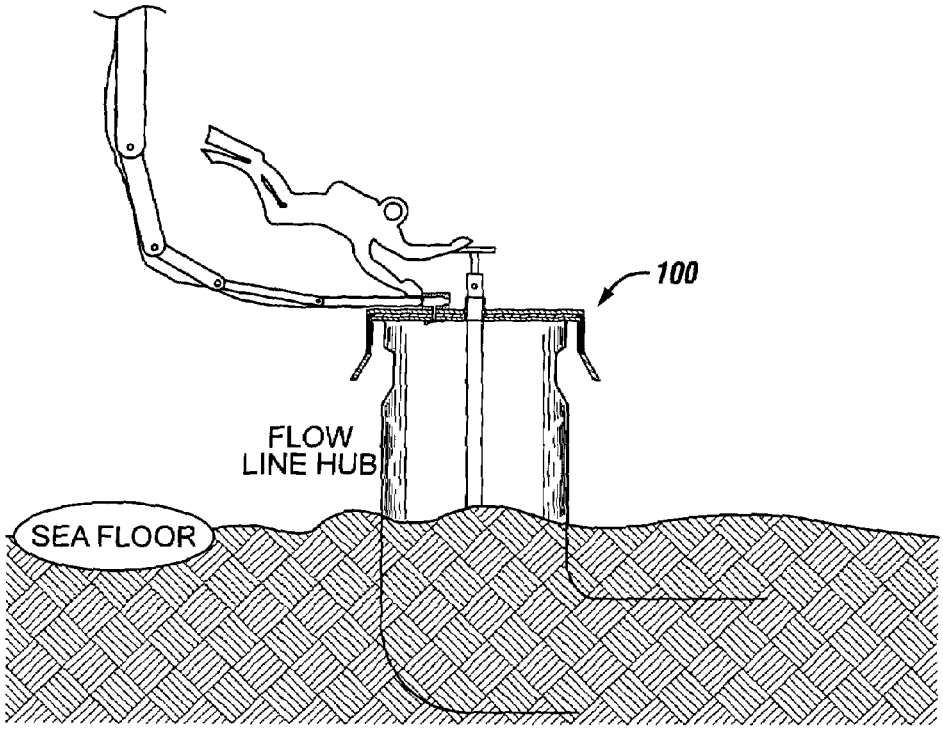
FIG. 6 is a side view of an embodiment of the invention being installed on a flow line hub by a diver.

The cap 100 is designed to provide protection from objects (not shown) falling or intruding into an exposed structure, such as the subsea tree in FIG. 5 and the flow line hub in FIG. 6. The cap 100 can also be used as a corrosion barrier in a marine environment for flow line hubs, subsea wellheads, caissons, subsea trees and other subsea structures (not shown). These structures are meant by way of example and are not meant to limit the scope of the invention.

The flanged, inverted bowl design, illustrated in FIG. 2 and FIG. 4, provides expedited installation by easing the cap 100 onto the structure once the cap 100 is positioned above the target structure by the ROV (as shown in FIG. 5) or by the diver (as shown in FIG. 6). The cap 100 can also be deployed by a cable (not shown).

In addition to using the cap 100 to protect the seal pockets in the wellhead, the cap 100 can also be used to contain a protective fluid (not shown) that can keep the seal pocket lubricated and can inhibit marine growth, if desired. The present invention 100 is placed over the open upper end of the structure to be protected and a preservative fluid (not shown) is injected, if required. The fluid can be injected into the cap 100 by inserting a stab into the stab receptacle 124 that is incorporated into the base 104, as shown in FIG. 2 or attached by other means. A diver-assisted hose and stinger, an ROV and stinger or an ROV and a surface-supplied hose and stinger can supply the fluid.

The cap 100 of the present invention is shown after installation on a subsea tree by an ROV in FIG. 5 and after installation on a flow line hub by a diver in FIG. 6.

The foregoing descriptions are illustrative only and it is understood that other means and techniques can be employed without departing from the full scope of the invention as described in the appended claims.

I claim:

1. A cap having a depth for covering an open upper end of a subsea structure, comprising:

a base comprising a metal plate encapsulated in a thermoplastic polymer, said base having a size, after shrinkage, at least slightly larger than the exterior of the open upper end of the subsea structure;

a body comprising a metal insert encapsulated in a thermoplastic polymer connected to and projecting downward from said base, said body having an open bottom;

an inlet in said cap;

a pipe inserted through an aperture in said base of said cap, wherein said pipe further comprises an outlet near the top of said pipe and wherein said pipe extends downwardly at least the depth of said cap; and wherein said cap is positioned over the open upper end of the subsea structure with said base of said cap resting on the open upper end of the subsea structure and said body of said cap forming a wall around the exterior of the open upper end of the subsea structure for inhibiting said cap from slipping off the open upper end of the subsea structure; and whereby a fluid may be inserted through said inlet into the open upper end of the subsea structure replacing seawater that flows up through said pipe and out of said cap through said outlet.

2. The cap of claim 1, further comprising a handle attached to said cap for facilitating the installation of said cap to and removal of said cap from the subsea structure.

3. The cap of claim 1, wherein said thermoplastic polymer is selected from the group consisting of polypropylene, polyethylene and polyurethane.

4. The cap of claim 1, further comprising a flared skirt connected to and projecting downwardly from said body, wherein said flared skirt facilitates positioning of said cap over the open tipper end of the subsea structure.

5. A cap having a depth for covering an open upper end of a subsea structure, comprising:

a base comprising a metal plate encapsulated in a thermoplastic polymer, having a size, after shrinkage, at least slightly larger than the exterior of the open upper end of the subsea structure;

a body comprising a metal plate encapsulated in a thermoplastic polymer, connected to and projecting downward from said base, said body having an open bottom;

a flared skirt connected to and projecting downwardly from said body, wherein said flared skirt facilitates positioning of said cap over the open upper end of the subsea structure; and a handle attached to said cap for facilitating the installation of said cap to and removal of said cap from the subsea structure;

an inlet in said cap;

a pipe inserted through an aperture in said base of said cap, wherein said pipe further comprises an outlet near the top of said pipe and wherein said pipe extends downwardly at least the depth of said cap; and wherein said cap is positioned over the open upper end of the subsea structure with said base of said cap resting on the open upper end of the subsea structure and said body of said cap forming a wall around the exterior of the open upper end of the subsea structure for inhibiting said cap from slipping off the open upper end, and whereby a fluid may be inserted through said inlet into the open upper end of the subsea structure replacing seawater that flows up through said pipe and out of said cap through said outlet.

6. The cap of claim 5, wherein said thermoplastic polymer is selected from the group consisting of polypropylene, polyethylene and polyurethane.

7. A lightweight cap having a depth, installable and removable by a cable or Remotely-Operated Vehicle, for covering an open upper end of a subsea structure, comprising:

a base comprising a metal plate encapsulated in a thermoplastic polymer having a size, after shrinkage, at least slightly larger than the exterior of the open upper end of the subsea structure; and a body comprising a metal plate encapsulated in a thermoplastic polymer connected to and projecting downward from said base, said body having an open bottom;

an inlet in said cap;

a pipe inserted through an aperture in said base of said cap, wherein said pipe further comprises an outlet near the top of said pipe and wherein said pipe extends downwardly at least the depth of said cap; and wherein said cap is positioned over the open upper end of the subsea stature with said base of said cap resting on the open upper end of the subsea structure and said body of said cap forming a wall around the exterior of the open upper end of the subsea structure, and whereby a fluid is inserted through said inlet into the open upper end of the subsea structure replacing seawater that flows up through said pipe and out of said cap through said outlet.

8. A lightweight cap having a depth, installable and removable by a diver, for covering an open upper end of a subsea structure, comprising:

a base comprising a metal plate encapsulated in a thermoplastic polymer, having a size, after shrinkage, at least slightly larger than the exterior of the open upper end or the subsea structure; and a body comprising a metal plate encapsulated in a thermoplastic polymer, connected to and projecting downward from said base, said body having an open bottom;

an inlet in said cap;

a pipe inserted through an aperture in said base of said cap, wherein said pipe further comprise an outlet near the top of said pipe and wherein said pipe extends downwardly at least the depth of said cap; and wherein said cap is positioned over the open upper end of the subsea structure with said base of said cap resting on the open upper end of the subsea structure and said body of said cap forming a wall around the exterior of the open upper end of the subsea structure; and whereby a fluid may be inserted through said inlet into the open upper end of the subsea structure replacing seawater that flows up through said pipe and out of said cap through said outlet.

9. A method of projecting an open upper end of a subsea structure, comprising the steps of:

positioning a cap having a depth above the open upper end of the subsea structure;

wherein said cap comprises;

a base comprising a metal plate encapsulated in a thermoplastic polymer, having a size, after shrinkage, at least slightly larger than the exterior of the open upper end of the subsea structure;

and a body comprising a metal plate encapsulated in a thermoplastic polymer, connected to and projecting downward from said base, said body having an open bottom;

an inlet in said cap and a pipe inserted through an aperture in said base of said cap, wherein said pipe further comprises an outlet near the top of said pipe and wherein said pipe extends downwardly at least the depth of said cap; and lowering said cap over the open upper end of the subsea structure until said base of said cap rests on the open upper end of the subsea structure and said body of said cap encircles the exterior of the open upper end of the subsea structure, thereby inhibiting said cap from slipping off the open upper end of the subsea structure; and inserting a fluid through said inlet into the open upper end of the subsea structure replacing seawater that flows up through said pipe and out of said through said outlet.

10. The protection method of claim 9, wherein said cap further comprises:

a flared skirt connected to and projecting downwardly from said body, wherein said flared skirt facilitates positioning of said cap over the open upper end of the subsea structure; and a handle attached to said cap for facilitating the installation of said cap to and removal of said cap from the subsea structure; and wherein said cap is positioned over the open upper end of the subsea structure with said base of said cap resting on the open upper end of the subsea structure and said body of said cap encircling the exterior of the open upper end of the subsea structure for inhibiting said cap from slipping off the open upper end of the subsea structure.

11. A method for protecting an open upper end of a subsea structure, comprising the steps of:

positioning a cap having a depth above the open upper end of the subsea structure;

wherein said cap comprises:

a base comprising a metal plate encapsulated in a thermoplastic polymer, having a size, after shrinkage, at least slightly larger than the exterior of the open upper end of the subsea structure;

a body comprising a metal plate encapsulated in a thermoplastic polymer, connected to and projecting downward from said base, said body having an open bottom;

a flared skirt connected to and projecting downwardly from said body, wherein said flared skirt facilitates positioning of said cap over the open upper end of the subsea structure;

a handle attached to said cap for facilitating the installation of said cap to and removal of said cap from the subsea structure;

an inlet in said cap;

a pipe inserted through an aperture in said base of said cap wherein said pipe extends downwardly at least the depth of said cap; and an outlet near the top of said pipe;

lowering said cap onto the subsea structure until said base rests on the open upper end of the subsea structure and said body of said cap encircles the exterior of the open upper end of the subsea structure to inhibit said cap from slipping off of the open upper end of the structure; and inserting a fluid through said inlet into the open upper end of the subsea structure, thereby displacing seawater which flows up through said pipe and out of said cap through said outlet.

* * * * *